US011757205B2

(12) United States Patent
Stepanenko et al.

(10) Patent No.: US 11,757,205 B2
(45) Date of Patent: Sep. 12, 2023

(54) LOW-COST COMPACT CIRCULARLY POLARIZED PATCH ANTENNA WITH SLOT EXCITATION FOR GNSS APPLICATIONS

(71) Applicant: Topcon Positioning Systems, Inc., Livermore, CA (US)

(72) Inventors: Anton Pavlovich Stepanenko, Moscow (RU); Andrey Vitalievich Astakhov, Moscow (RU); Sergey Nikolaevich Yemelianov, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 169 days.

(21) Appl. No.: 17/594,135

(22) PCT Filed: Mar. 25, 2021

(86) PCT No.: PCT/RU2021/000119
§ 371 (c)(1),
(2) Date: Oct. 4, 2021

(87) PCT Pub. No.: WO2022/203534
PCT Pub. Date: Sep. 29, 2022

(65) Prior Publication Data
US 2022/0344831 A1 Oct. 27, 2022

(51) Int. Cl.
*H01Q 21/06* (2006.01)
*H01Q 13/10* (2006.01)
(Continued)

(52) U.S. Cl.
CPC ..... *H01Q 21/064* (2013.01); *H01Q 9/0428* (2013.01); *H01Q 9/0435* (2013.01); *H01Q 13/106* (2013.01); *H01Q 21/20* (2013.01)

(58) Field of Classification Search
CPC .... H01Q 21/064; H01Q 13/106; H01Q 21/20; H01Q 9/0421; H01Q 9/0435; H01Q 9/0464; H01Q 9/0428; H01Q 5/328
See application file for complete search history.

(56) References Cited

U.S. PATENT DOCUMENTS 5,818,391 A * 10/1998 Lee ..... H01Q 5/42 343/769
7,250,916 B2 7/2007 Kunysz et al.
(Continued)

FOREIGN PATENT DOCUMENTS

| | | | |
|---|---|---|---|
| CN | 102882006 | A | 1/2013 |
| CN | 110957572 | A | 4/2020 |
| WO | 2019216721 | A1 | 11/2019 |

OTHER PUBLICATIONS

International Search Report and Written Opinion dated Dec. 2, 2021, in connection with International Patent Application No. PCT/RU2021/000119, filed Mar. 25, 2021, 7 pgs.

*Primary Examiner* — Vibol Tan
(74) *Attorney, Agent, or Firm* — CHIESA SHAHINIAN & GIANTOMASI PC

(57) ABSTRACT

An antenna comprising a ground plane, a composite radiation patch, and an excitation circuit is described herein. The composite radiation patch is disposed on a printed circuit board and comprises a conducting plate and a plurality of conductive strips. The composite radiation patch comprises an outer region and an inner region separated by a circle of a given radius. The conducting plate comprises 1) a first set of arcuate slots disposed on the circle and 2) a second set of slots each contacting an external perimeter of the conducting plate at one end and a corresponding slot of the first set of arcuate slots at another end. The plurality of conductive strips is disposed within the outer region of the composite radiation patch, with one or more of the plurality of con-
(Continued)

ductive strips galvanically contacting the conducting plate. The excitation circuit is disposed on the printed circuit board for exciting a right hand circularly polarized wave. The excitation circuit comprises a plurality of microstrip lines and a feeding network to which the plurality of microstrip lines are connected.

15 Claims, 10 Drawing Sheets

(51) Int. Cl.
*H01Q 21/20* (2006.01)
*H01Q 9/04* (2006.01)

(56) References Cited

U.S. PATENT DOCUMENTS

| | | | | |
|---|---|---|---|---|
| 8,174,450 | B2 | 5/2012 | Tatarnikov et al. | |
| 8,624,792 | B2 | 1/2014 | Popugaev et al. | |
| 8,723,731 | B2 * | 5/2014 | Tatarnikov | H01Q 1/36 343/797 |
| 9,184,504 | B2 * | 11/2015 | Tatarnikov | H01Q 9/0464 |
| 9,203,150 | B2 * | 12/2015 | Tatarnikov | H01Q 1/1242 |
| 10,170,823 | B2 * | 1/2019 | Tatarnikov | H01Q 1/3233 |
| 11,011,849 | B2 * | 5/2021 | Hsiao | H01Q 1/38 |
| 2014/0210678 | A1 | 7/2014 | Chen et al. | |
| 2020/0106176 | A1 | 4/2020 | Kaumann et al. | |
| 2020/0271777 | A1 | 8/2020 | Vacanti et al. | |
| 2021/0126358 | A1 | 4/2021 | Seo et al. | |

* cited by examiner

200

200

LOW-COST COMPACT CIRCULARLY POLARIZED PATCH ANTENNA WITH SLOT EXCITATION FOR GNSS APPLICATIONS

TECHNICAL FIELD

The present invention relates generally to antennas, and more particularly to low-cost compact broadband circularly-polarized antennas for receiving signals from Global Navigation Satellite Systems (GNSS).

BACKGROUND

Signals broadcast by GNSS satellites have Right-Handed Circular Polarization (RHCP). The full GNSS frequency band is divided into two frequency bands: low-frequency (LF) (about 1165-1300 MHz) and high-frequency (HF) (about 1525-1605 MHz).

To facilitate antenna operation in the two frequency bands, different stacked patch antennas are often used. Such an antenna is described, for instance, in U.S. Pat. No. 8,174,450. The radiation patch of the LF band patch antennas is located over the radiation patch of the HF band patch antennas. As the antenna design includes multiple levels, the total antenna height increases and the process of assembling antennas becomes more complicated, which results in an increase in cost.

The complexity of designing broadband antennas with one radiation patch excited by a vertical probe is related to the fact that ensuring a symmetrical radiation pattern (RP) with maximum radiation in the zenith direction and a stable phase center position can be achieved by exciting the radiation patch by four probes. Note that mirror-symmetrical pairs of probes should be in antiphase excitation. It is well known that broadband antiphase dividers with no loss take a large amount of space on a printed circuit board (PCB). U.S. Pat. No. 8,624,792 discloses a broadband GNSS antenna with one radiator being excited at four points using a feeding network. Such an antenna has a very simple radiator design, but the feeding network takes a large amount of space on the PCB and is located on the ground plane. The large amount of space of the feeding network on the PCB is due in part to the rat-race divider used therein, which is known to include a microstrip line with the size of ¾ wavelength.

U.S. Pat. No. 7,250,916 discloses an antenna having a set of slots in the metalized layer of the PCB, which is located above a ground plane. The antenna has a low height and a simple design in the form of one PCB disposed above the conducting surface. The simplicity of such an antenna is also provided by the lack of exciting vertical probes. In it, the excitation circuit is made as a microstrip feed line and the radiator and excitation circuit are located on the same PCB. However, the antenna has considerable lateral size: approximately 6.25 inches. Another drawback of this antenna is that the excitation microstrip feed line is situated within the central area of said PCB, which makes it difficult to locate low noise amplifiers (LNA) or vertical monopole antenna in this area.

BRIEF SUMMARY OF THE INVENTION

Embodiments described herein provide for a broadband circularly-polarized antenna for GNSS applications. The antenna has small dimensions, a simple structure and low cost. The antenna is also capable of accommodating both radiating elements and an excitation circuit with a feeding network and a low noise amplifier on the same printed circuit board.

In accordance with one or more embodiments, an antenna comprising a ground plane, a composite radiation patch, and an excitation circuit is provided. The composite radiation patch is disposed on a printed circuit board and comprises a conducting plate and a plurality of conductive strips. The composite radiation patch comprises an outer region and an inner region separated by a circle of a given radius. The conducting plate comprises 1) a first set of arcuate slots disposed on the circle and 2) a second set of slots each contacting an external perimeter of the conducting plate at one end and a corresponding slot of the first set of arcuate slots at another end. The plurality of conductive strips is disposed within the outer region of the composite radiation patch, with one or more of the plurality of conductive strips galvanically contacting the conducting plate. The excitation circuit is disposed on the printed circuit board for exciting a right hand circularly polarized wave. The excitation circuit comprises a plurality of microstrip lines and a feeding network to which the plurality of microstrip lines are connected.

In one embodiment, the composite radiation patch has 4-fold rotational symmetry.

In one embodiment, the plurality of arcuate slots of the first set of slots comprises four arcuate slots and the plurality of slots of the second set of slots comprises four slots. Each of the plurality of slots of the second set of slots may be shaped as a straight line or a zigzag line.

In one embodiment, the plurality of microstrip lines comprises four microstrip lines. The plurality of microstrip lines may each have a same length. Each of the plurality of microstrip lines may cross a corresponding slot of the second set of slots.

In one embodiment, the feeding network is disposed in the inner region of the composite radiation patch. The feeding network may comprise one quadrature divider and two in-phase decoupled power dividers. The feeding network may excite 1) in-phase waves in a first and a third microstrip lines of the plurality of microstrip lines, 2) in-phase waves in a second and a fourth microstrip lines of the plurality of microstrip lines, and 3) 90 degree shifted waves in the first and the second microstrip lines.

In one embodiment, the first and the third microstrip lines are mirror-symmetrical about a first axis passing through a center of the composite radiation patch, the second and the fourth microstrip lines are mirror-symmetrical about a second axis passing through the center of the composite radiation patch, and the first axis and the second axis are perpendicular to each other within a plane of the printed circuit board.

In one embodiment, a low noise amplifier is disposed on the printed circuit board in the inner region of the composite radiation patch.

In one embodiment, the antenna further comprises a bottom conducting plate comprising a horizontal base and a set of vertical pins along an outer perimeter of the horizontal base. The horizontal base is in contact with the ground plane and the set of vertical pins is directed towards the composite radiation patch. The antenna may further comprise an upper conducting plate comprising a horizontal base and a set of vertical pins along an outer perimeter of the horizontal base. A radius of the horizontal base may be less than or equal to the given radius. The horizontal base is in contact with the inner region of the composite radiation patch. The set of vertical pins is directed towards the ground plane.

These and other advantages of the invention will be apparent to those of ordinary skill in the art by reference to the following detailed description and the accompanying drawings.

DETAILED DESCRIPTION

Figure 1A:
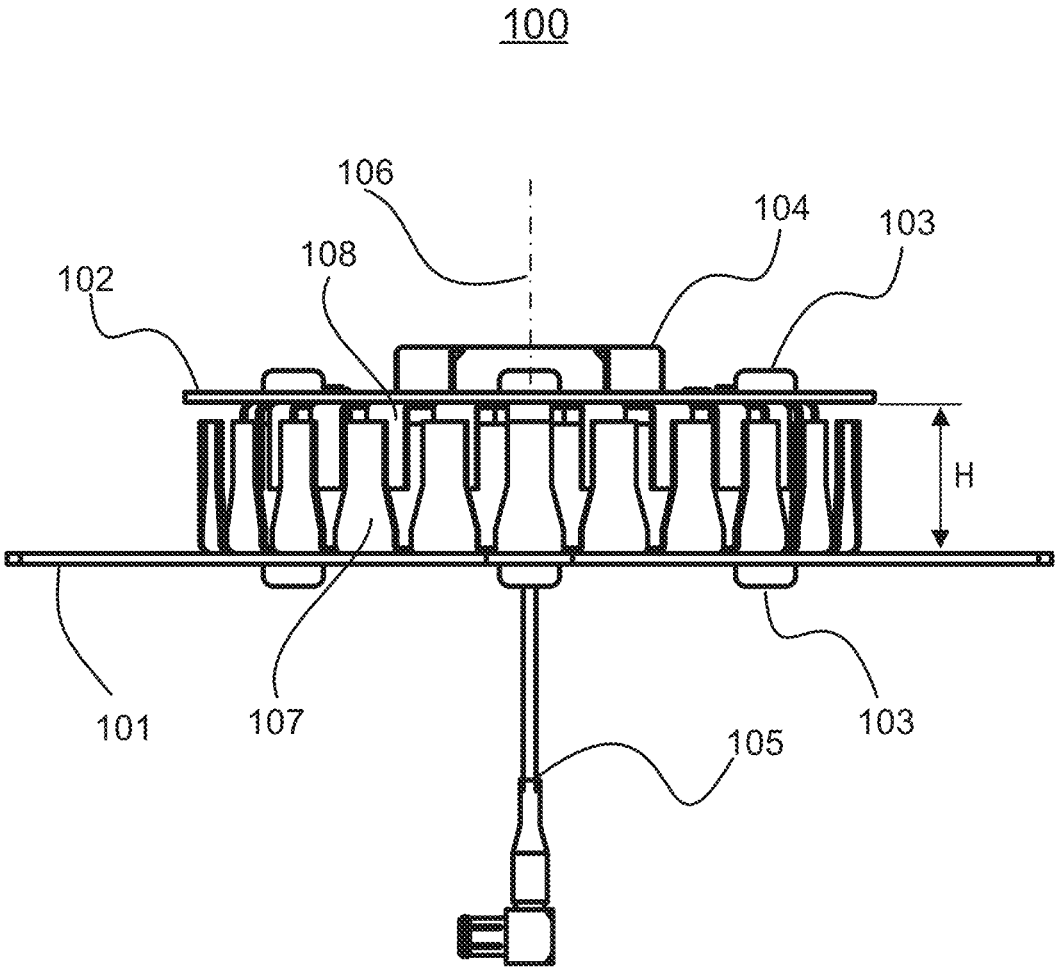
FIG. 1A shows a side view of an antenna, in accordance with one or more embodiments.
Figure 1B:
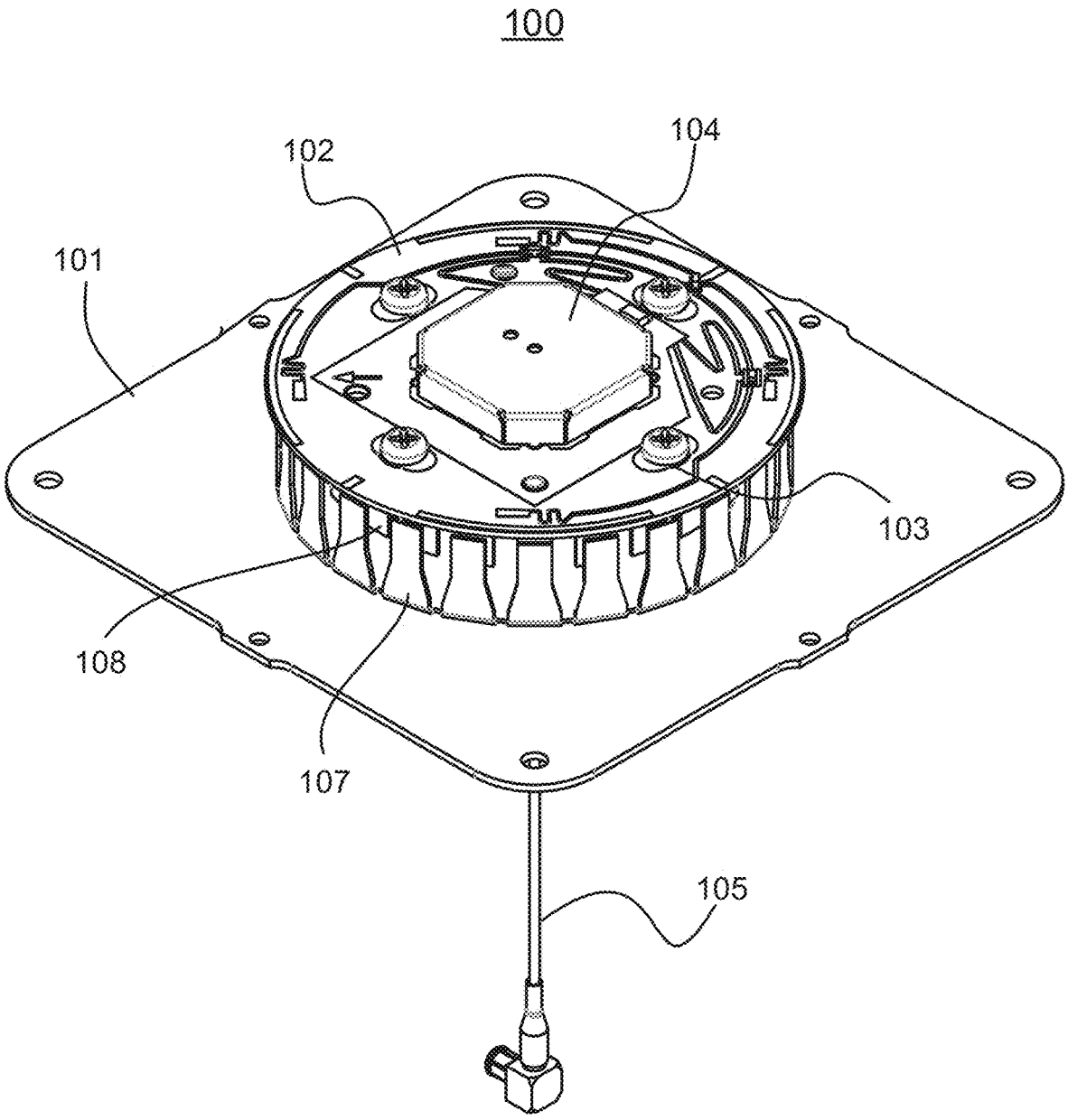
FIG. 1B shows an isometric view of an antenna, in accordance with one or more embodiments.

Embodiments disclosed herein will be described with reference to the drawings, in which like reference numerals represent the same or similar elements. FIGS. 1A-1B illustrate an antenna 100, in accordance with one or more embodiments. FIG. 1A shows a side view of antenna 100 and FIG. 1B shows an isometric view of antenna 100. Antenna 100 includes a conductive ground plane 101 and a PCB (printed circuit board) 102. A composite radiation patch (shown in FIGS. 2A-2E) and an excitation circuit (shown in FIG. 4) are disposed on PCB 102. PCB 102 can be mechanically fixed above ground plane 101 using plastic standoff blocks (not shown in FIG. 1A or FIG. 1*b*), in which securing screws 103 are screwed. An LNA (low noise amplifier) (shown in FIG. 4) enclosed by shield 104 can be disposed on PCB 102. The output of the LNA is connected to cable 105. Cable 105 passes from PCB 102 through ground plane 101. Between PCB 102 and ground plane 101, cable 105 is placed onto the vertical symmetry axis 106 of the proposed antenna.

Figure 3A:
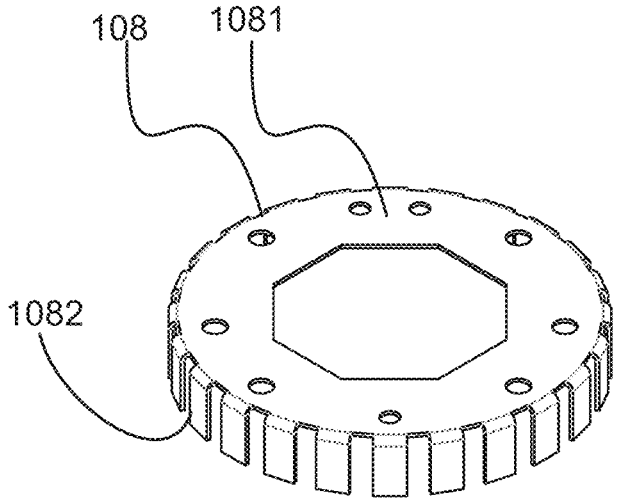
FIG. 3A shows an upper conducting plate, in accordance with one or more embodiments.
Figure 3B:
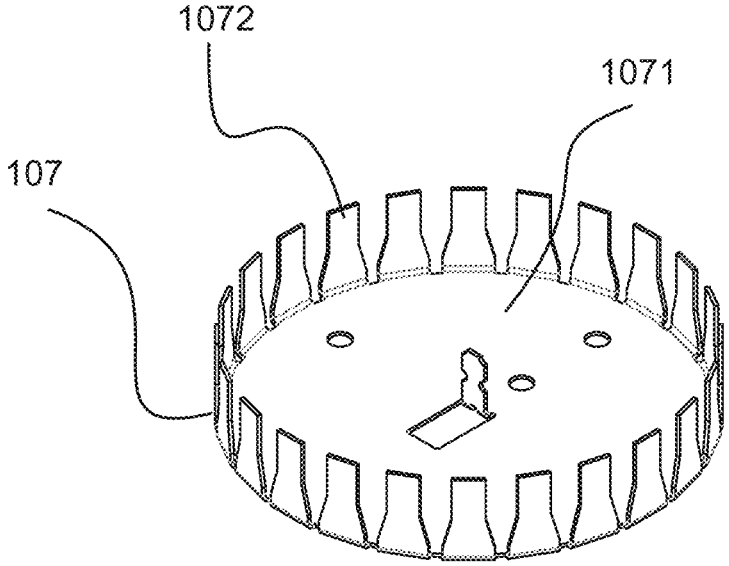
FIG. 3B shows a bottom conducting plate, in accordance with one or more embodiments.

To reduce the spatial dimensions of height H between PCB 102 and ground plane 101 of antenna 100, an interdigital comb-like structure in the form of bent conducting plates 107 and 108 may be utilized, as described in further detail with respect to FIGS. 3A-3B.

Figure 2A:
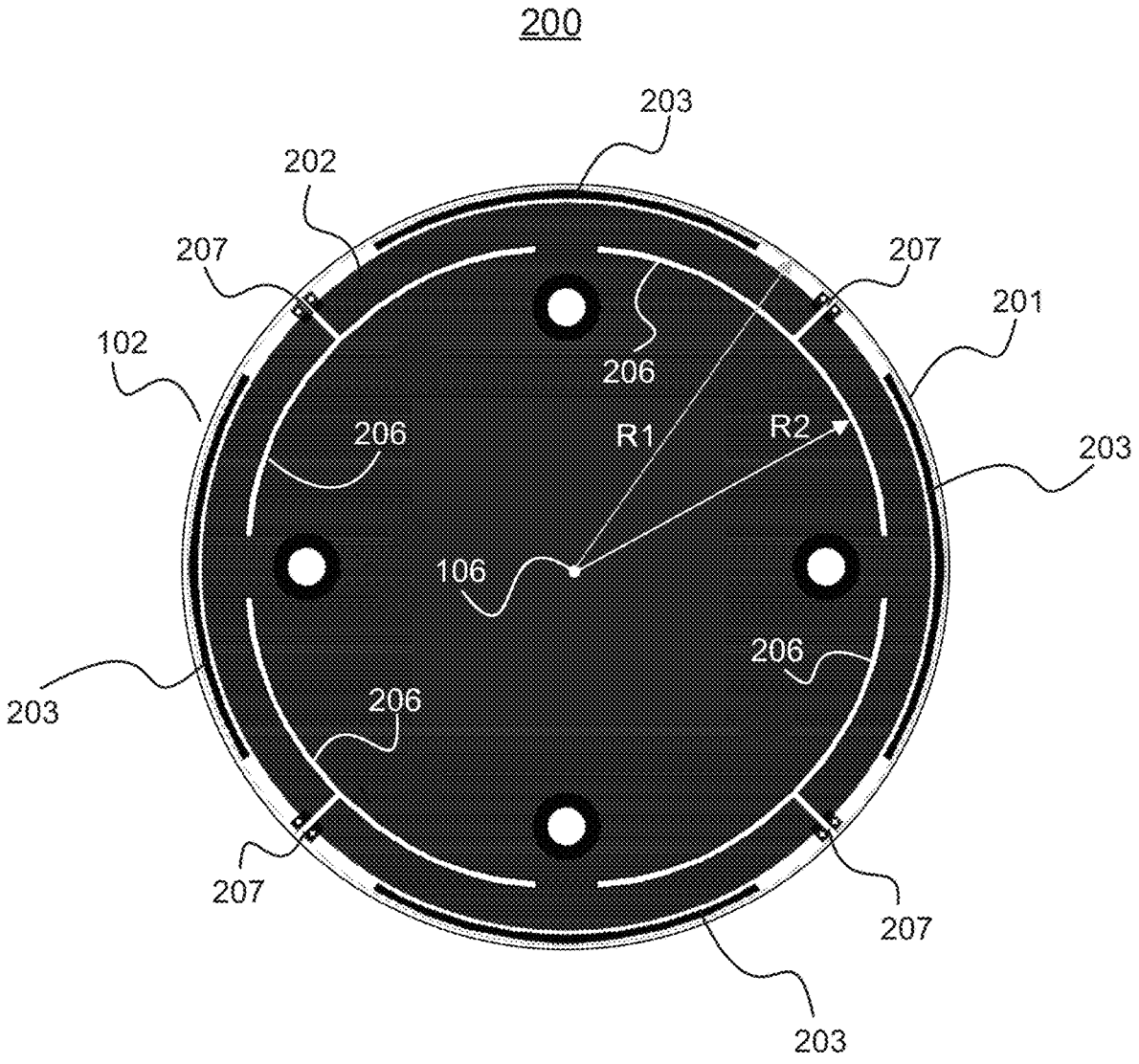
FIG. 2A shows a bottom metallization layer of a composite radiation patch, in accordance with one or more embodiments.
Figure 2B:
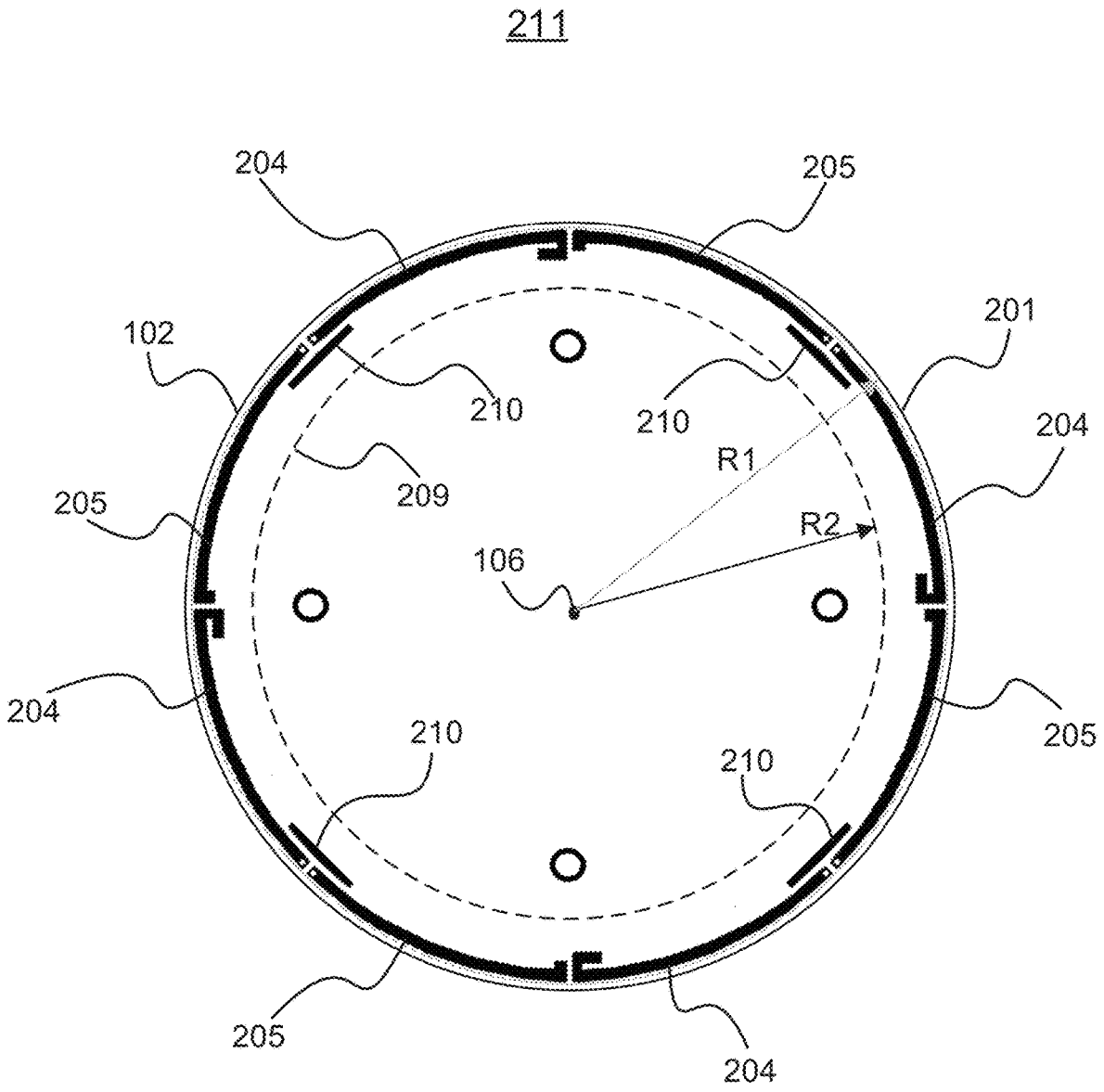
FIG. 2B shows an upper metallization layer of a composite radiation patch, in accordance with one or more embodiments.

FIGS. 2A-2E show a composite radiation patch disposed on PCB 102 of antenna 100, in accordance with one or more embodiments. FIG. 2A shows a bottom metallization layer 200 of the composite radiation patch disposed on PCB 102 and FIG. 2B illustrates an upper metallization layer 211 of the composite radiation patch disposed on PCB 102. PCB 102 has an external perimeter 201 with radius R1. The composite radiation patch includes conducting plate 202 and a plurality of conductive strips 203, 204, 205 and 210. Conducting plate 202 can be disposed on the bottom metallization layer 200 on PCB 102. Different conductive strips can also be located on both the bottom metallization layer 200 and upper metallization layer 211 of the composite radiation patch.

The composite radiation patch comprises an outer region and an inner region separated or delineated by circle 209 of radius R2. The inner region of the composite radiation patch is bounded within the boundary of circle 209. The outer region of the composite radiation patch is bounded between the boundary of circle 209 and external perimeter 201 of PCB 102. Conducting plate 202 comprises a first set of arcuate slots and a second set of slots. The first set of arcuate slots comprises four arcuate slots 206, which are arcs disposed on circle 209 of radius R2 having a center on symmetry axis 106. The second set of slots comprises four slots 207. Each of the four slots 207 of the second set of slots contacts external perimeter 201 of conducting plate 202 at one end and a corresponding slot of the four arcuate slots 206 of the first set of arcuate slots at another end.

Figure 2C:
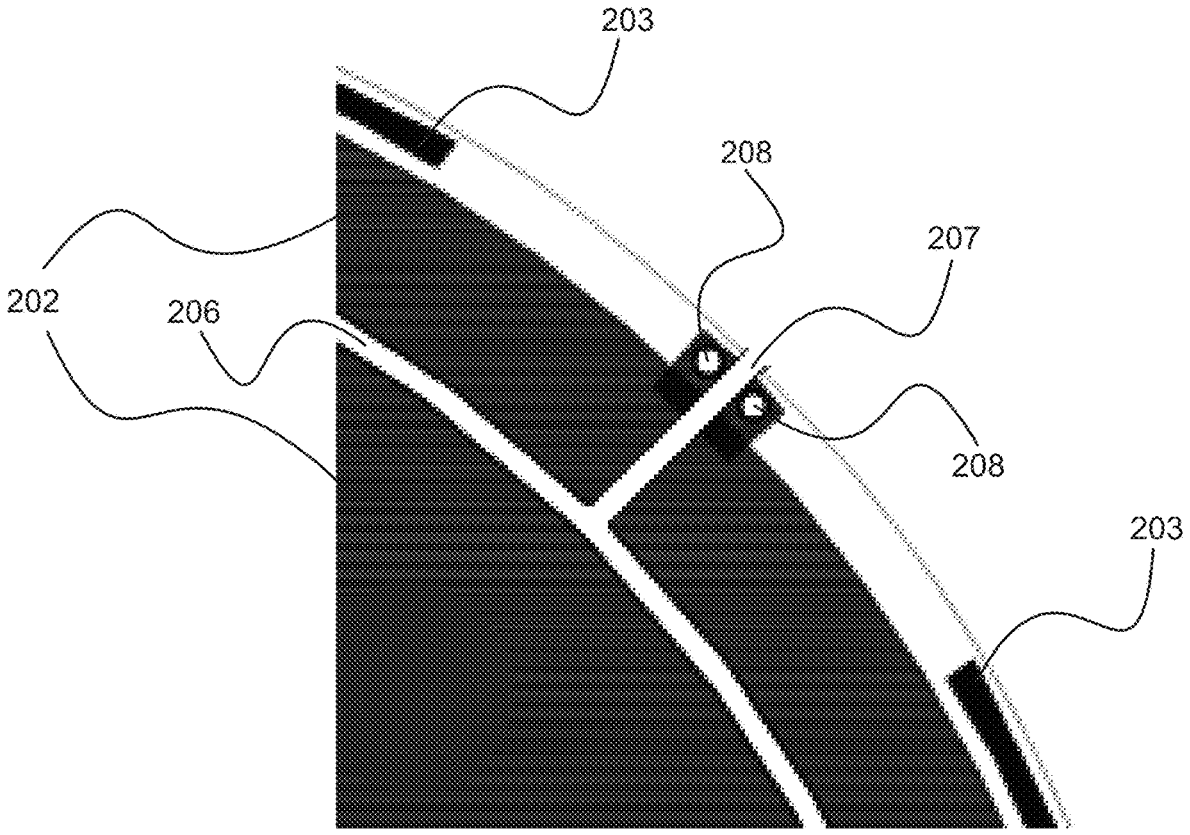
FIG. 2C shows an enlarged view of a bottom metallization layer, in accordance with one or more embodiments.
Figure 2D:
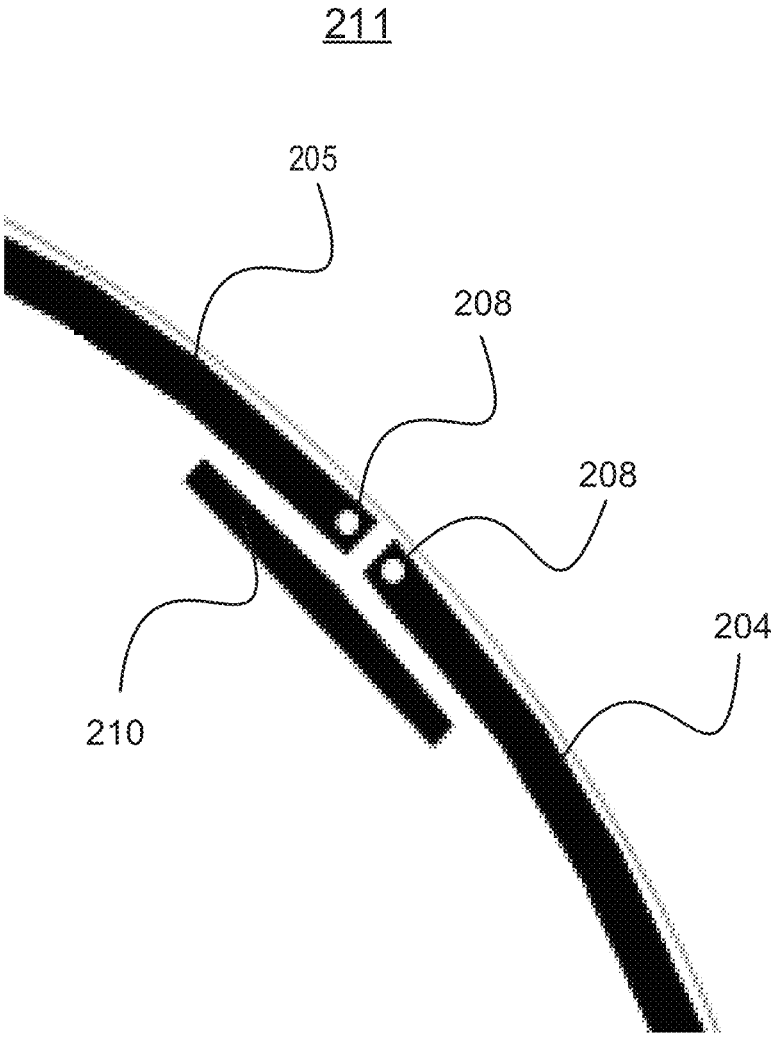
FIG. 2D shows an enlarged view of an upper metallization layer, in accordance with one or more embodiments.

The composite radiation patch also comprises a plurality of conductive strips 203, 204, 205 and 210 disposed within the outer region of the composite radiation patch. One or more of the plurality of conductive strips 203, 204, 205 and 210 may have a galvanic contact for galvanically contacting conducting plate 202, while one or more of the plurality of conductive strips 203, 204, 205 and 210 may not have a galvanic contact for galvanically contacting conducting plate 202. Conductive strips 203 are located on bottom metallization layer 200 of the composite radiation patch and have no galvanic contact with conducting plate 202. Conductive strips 204 and 205 are located on the upper metallization layer 211 of the composite radiation patch and have a galvanic contact with conducting plate 202. The galvanic contact of conductive strips 204 and 205 is provided by metallized holes 208, which are shown in FIG. 2C and FIG. 2D. FIG. 2C shows an enlarged view of bottom metallization layer 200 of FIG. 2A and FIG. 2D show an enlarged view of upper metallization layer 211 shown in FIG. 2B, in accordance with one or more embodiments. Conductive strips 210 are located on upper metallization layer 211 and have no galvanic contact with conducting plate 202. One or more of the plurality of conductive strips may be outside the perimeter of conducting plate 202, may cross the perimeter of conducting plate 202 and/or may be on the perimeter of conducting plate 202. Thus, conductive strips 203 and 205 are outside the perimeter of conductive plate 202, conductive strips 210 are disposed on the external perimeter of conducting plate 202, and conductive strips 204 cross the perimeter of conducting plate 202.

In one embodiment, conductive strips 204 and 205, which are close to the perimeter of the conducting plate, have galvanic contact with conducting plate 202 next to slot 207. FIG. 2C and FIG. 2D show metallized holes 208 providing galvanic contact for conductive strips 204 and 205 with conducting plate 202. Metallized holes 208 are located near slot 207 on the opposite sides of it.

Figure 2E:
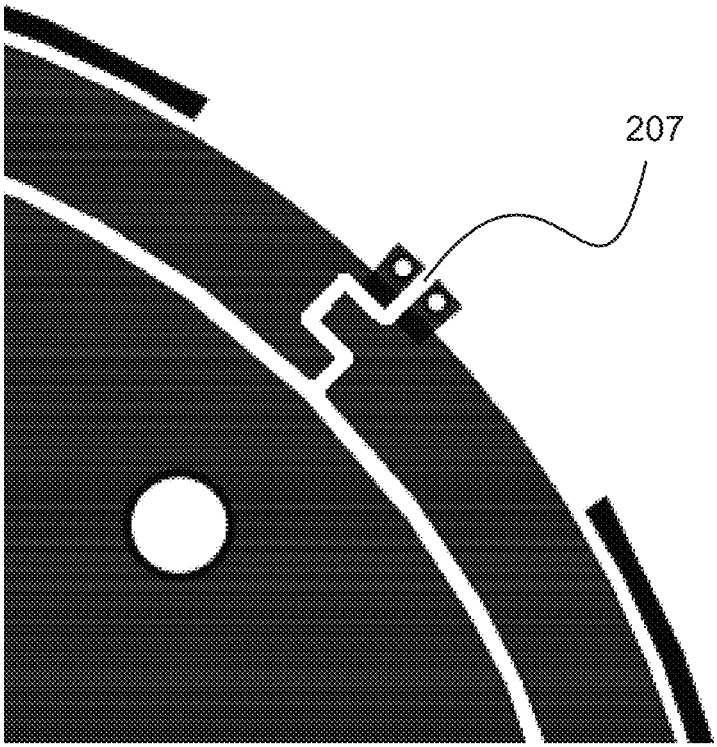
FIG. 2E shows a slot of the second set of slots shaped as a zigzag line, in accordance with one or more embodiments.

FIG. 2C shows slot 207 on bottom metallization layer 200 shaped as a straight line, in accordance with one or more embodiments. FIG. 2E shows slot 207 on bottom metallization layer 200 shaped as a zigzag line, in accordance with one or more embodiments.

Conducting plate 202 with slots 206 and 207 and conductive strips 203, 204, 205, and 210 are situated such that the composite radiation patch formed by them has 4-fold rotation symmetry relative to vertical axis 106, i.e., when turned 90 degrees, the composite radiation patch transforms into itself.

FIGS. 3A-3B show bent conducting plates 107 and 108 of antenna 100, in accordance with one or more embodiments. FIG. 3A shows upper conducting plate 108 and FIG. 3B shows bottom conducting plate 107. Conducting plates 107 and 108 have respective horizontal bases 1071 and 1081 and a set of vertical pins 1072 and 1082. Vertical pins 1072 and 1082 are along the outer perimeter of horizontal bases 1071 and 1081, respectively. In antenna 100, bottom conducting plate 107 is in contact with ground plane 101 and upper conducting plate 108 is located under PCB 102. The radius of the horizontal base of upper conducting plate 108 is less than or equal to radius R2 of circle 209, so that upper conducting plate 108 does not contact the outer region of the composite radiation patch. Conducting plates 107 and 108 can be made by cutting from sheet-like conducting material with further bending. Conducting plates 107 and 108 form an interdigital structure from the set of vertical pins 1072 and 1082, with set of vertical pins 1072 being directed towards the composite radiation patch and set of vertical pins 1082 being directed towards the ground plane 101. Any contact of pins 1072 with ground plane 101 is provided by adjoining horizontal base 1071 to ground plane 101. Contact of pins 1082 with the composite radiation patch is guaranteed by adjoining horizontal base 1081 to the inner region of bottom metallization layer 200 on PCB 102 of the composite radiation patch. Such an interdigital structure results in reduced antenna dimensions. The interdigital structure is formed by only two parts without soldering, making the antenna design simpler and less expensive.

Figure 4:
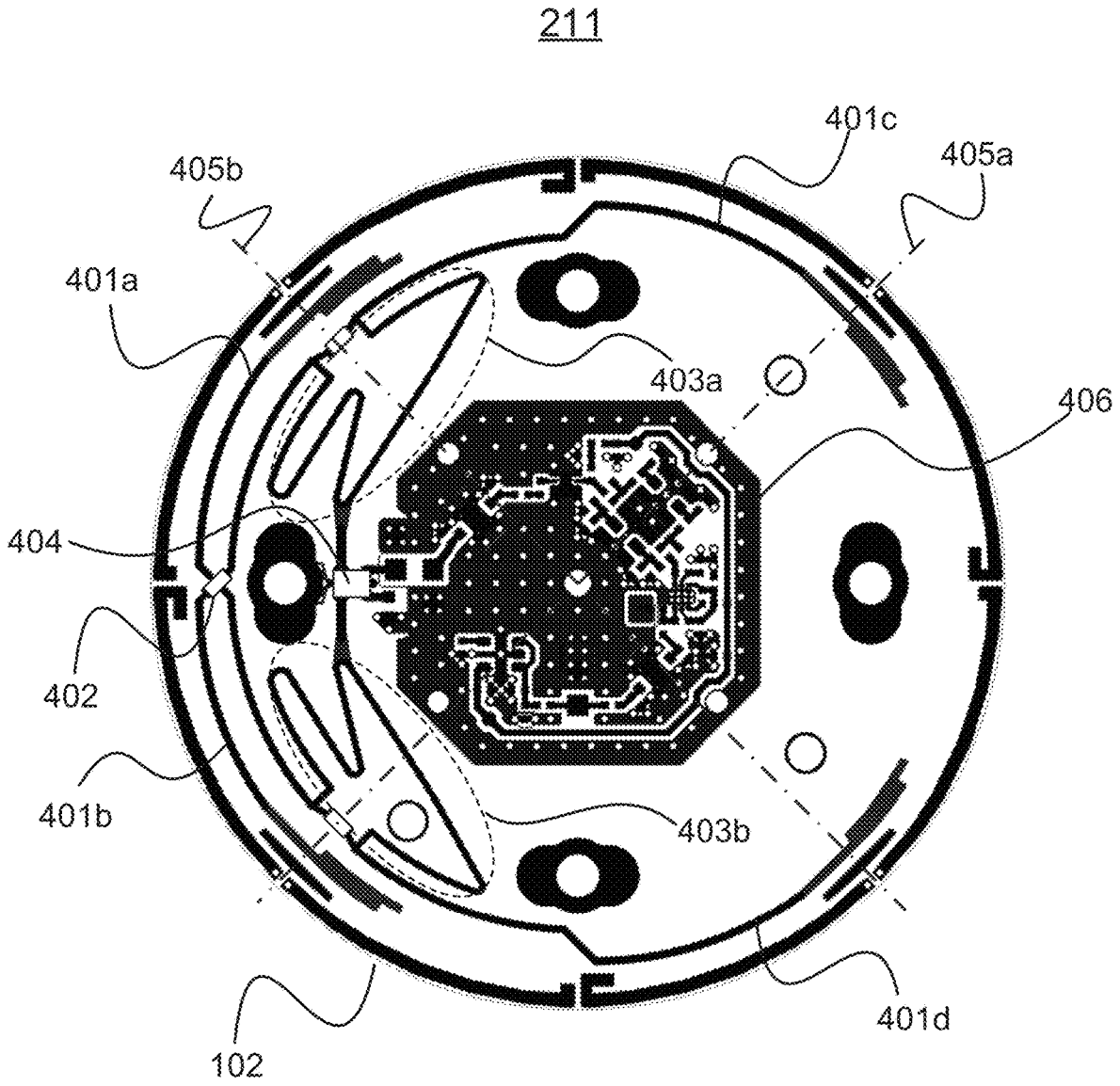
FIG. 4 shows an upper metallization layer having an excitation circuit disposed thereon, in accordance with one or more embodiments.

FIG. 4 shows upper metallization layer 211 of PCB 102 having an excitation circuit disposed thereon, in accordance with one or more embodiments. The excitation circuit comprises: a plurality of microstrip lines 401*a*, 401*b*, 401*c*, 401*d* and a feeding network connected to these lines. Each microstrip line 401*a*, 401*b*, 401*c*, 401*d* on the upper metallization layer 211 of PCB 102 crosses a corresponding slot 207 of conducting plate 202 disposed in the bottom metallization layer 200 of PCB 102. Since microstrip lines 401*a* and 401*b* cross each other, capacitor 402 is provided in line 401*b* to avoid galvanic contact between said lines. Capacitor 402 has an impedance near a short circuit on the operating frequency.

Microstrip lines 401*a*, 401*b*, 401*c*, 401*d* have the same length. Lines 401*a* and 401*d* are mirror-symmetrical about axis 405*a*. The currents flowing along these lines are in phase. They excite a linear-polarized wave parallel to axis 405*a*. Lines 401*b* and 401*c* are mirror-symmetrical about axis 405*b*. The currents flowing along these lines are in phase. They excite a linear-polarized wave parallel to the axis 405*b*. Axes 405*a* and 405*b* pass through the center of PCB 102 and are perpendicular to each other.

The feeding network is disposed in the inner region of the composite radiation patch and comprises two in-phase decoupled power dividers 403*a*, 403*b* and one quadrature power divider 404. In-phase decoupled power divider 403*a* excites in-phase waves in microstrip lines 401*a* and 401*d* and in-phase decoupled power divider 403*b* excites in-phase waves in microstrip lines 401*b* and 401*c*. Quadrature power divider 404 is connected to inputs of in-phase decoupled power dividers 403*a* and 403*b* so that the feeding network excites 90 degree shifted waves in microstrip lines 401*a* and 401*b* as well as in microstrip lines 401*c* and 401*d*. In-phase decoupled power dividers 403*a* and 403*b* can be configured as Wilkinson dividers.

In-phase dividers 403*a* and 403*b* are connected to quadrature divider 404, which is made in the form of quadrature chip power divider. In such a way, excitation of right hand circular polarization (RHCP) waves is provided by the excitation circuit, the wave being symmetrical about vertical axis 106. Only in-phase and quadrature dividers are in the excitation circuit, with the dividers having a wide operational frequency band. Their outputs are isolated from each other due to ballast resistors. At this, slots 207 are excited by equally-long lines. The described excitation circuit takes little space on PCB 102 and still provides a symmetrical Radiation Pattern and stable phase center within a wide frequency range.

The output of the quadrature divider 404 is the antenna output port. It can be connected to LNA 406 located on PCB 102. LNA 406 is disposed in PCB 102 in the inner region of the composite radiation patch.

Figure 5:
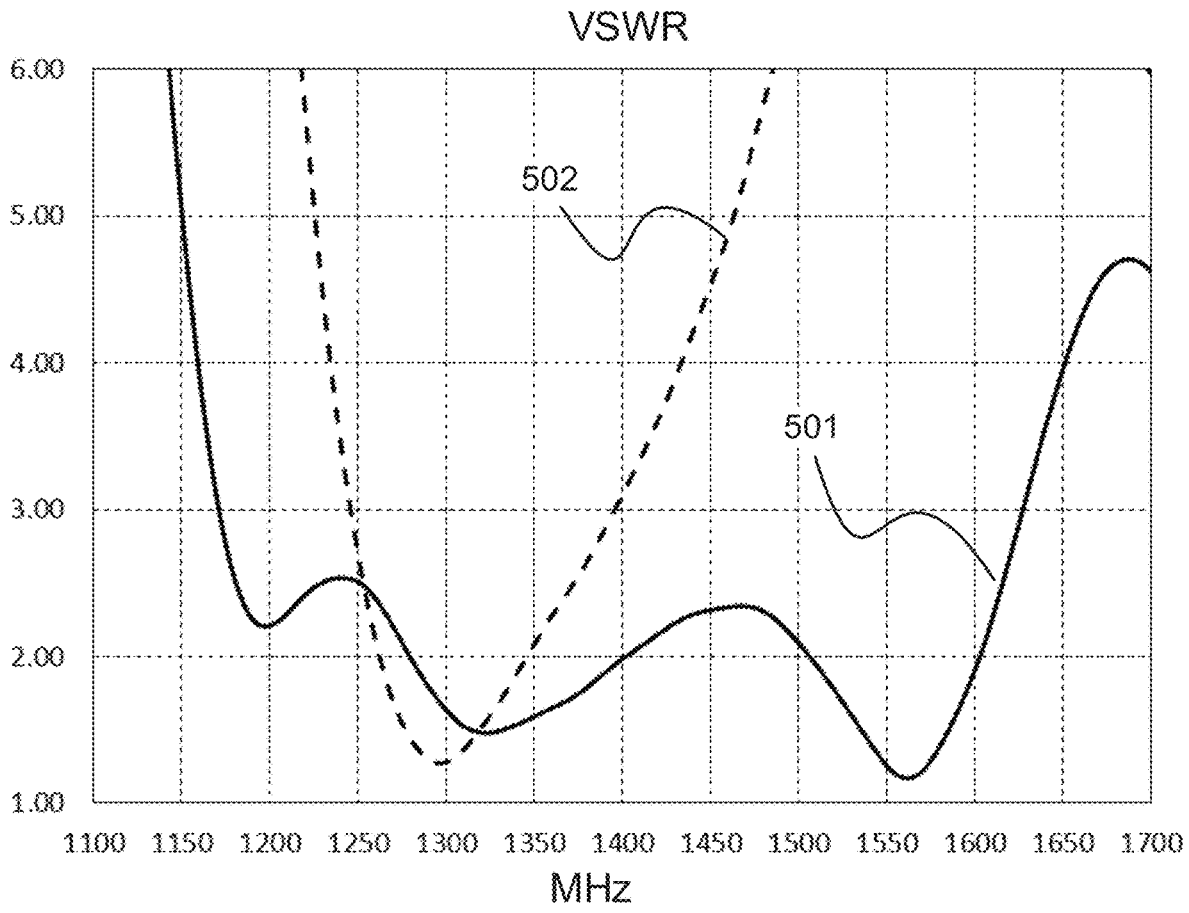
FIG. 5 shows an experimental graph depicting the dependent of voltage standing wave ratio (VSWR) on frequency for the antenna in accordance with one or more embodiments.

FIG. 5 shows experimental graph 501 depicting the dependence of voltage standing wave ratio (VSWR) on frequency for the proposed antenna for the case of linear polarization only, in accordance with one or more embodiments. The antenna has the following geometric parameters: R1=63 mm, R2=53 mm, H=14 mm. Experimental graph 502 is also shown for the case of the absence of conductive strips. It can be seen that the availability of conductive strips considerably expands the operational frequency range. The level of VSWR achieved in this case is no less than 2.5 in the entire GNSS band.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. An antenna comprising:

a ground plane;

a composite radiation patch disposed on a printed circuit board and comprising a conducting plate and a plurality of conductive strips, the composite radiation patch comprising an outer region and an inner region separated by a circle of a given radius, wherein the conducting plate comprises 1) a first set of arcuate slots disposed on the circle and 2) a second set of slots each contacting an external perimeter of the conducting plate at one end and a corresponding slot of the first set of arcuate slots at another end, and wherein the plurality of conductive strips is disposed within the outer region of the composite radiation patch, one or more of the plurality of conductive strips galvanically contacting the conducting plate; and an excitation circuit disposed on the printed circuit board for exciting a right hand circularly polarized wave, the excitation circuit comprising a plurality of microstrip lines and a feeding network to which the plurality of microstrip lines are connected.

2. The antenna of claim 1, wherein the composite radiation patch has 4-fold rotational symmetry.

3. The antenna of claim 1, wherein the first set of arcuate slots comprises four arcuate slots and the second set of slots comprises four slots.

4. The antenna of claim 1, wherein each of the second set of slots is shaped as a straight line.

5. The antenna of claim 1, wherein each of the second set of slots is shaped as a zigzag line.

6. The antenna of claim 1, wherein the plurality of microstrip lines comprises four microstrip lines.

7. The antenna of claim 1, wherein the plurality of microstrip lines each have a same length.

8. The antenna of claim 1, wherein each of the plurality of microstrip lines cross a corresponding slot of the second set of slots.

9. The antenna of claim 1, wherein the feeding network is disposed in the inner region of the composite radiation patch.

10. The antenna of claim 1, wherein the feeding network comprises one quadrature divider and two in-phase decoupled power dividers.

11. The antenna of claim 1, wherein the feeding network excites 1) in-phase waves in a first and a third microstrip lines of the plurality of microstrip lines, 2) in-phase waves in a second and a fourth microstrip lines of the plurality of microstrip lines, and 3) 90 degree shifted waves in the first and the second microstrip lines.

12. The antenna of claim 11, wherein the first and the third microstrip lines are mirror-symmetrical about a first axis passing through a center of the composite radiation patch, the second and the fourth microstrip lines are mirror-symmetrical about a second axis passing through the center of the composite radiation patch, and the first axis and the second axis are perpendicular to each other within a plane of the printed circuit board.

13. The antenna of claim 1, further comprising:

a low noise amplifier disposed on the printed circuit board in the inner region of the composite radiation patch.

14. The antenna of claim 1, further comprising:

a bottom conducting plate comprising a horizontal base and a set of vertical pins along an outer perimeter of the horizontal base, the horizontal base being in contact with the ground plane and the set of vertical pins being directed towards the composite radiation patch.

15. The antenna of claim 1, further comprising:

an upper conducting plate comprising a horizontal base and a set of vertical pins along an outer perimeter of the horizontal base, a radius of the horizontal base being less than or equal to the given radius, the horizontal base being in contact with the inner region of the composite radiation patch, and the set of vertical pins being directed towards the ground plane.

* * * * *